United States Patent [19]
Lawson
[11] 4,253,941
[45] Mar. 3, 1981

[54] CONTROLLED BUOYANCY SEPARATOR APPARATUS AND METHOD

[76] Inventor: William J. Lawson, R.D. 1, Box 299E, Milton, Del. 19968

[21] Appl. No.: 81,311

[22] Filed: Oct. 3, 1979

[51] Int. Cl.³ ..... B03B 5/66

[52] U.S. Cl. ..... 209/17; 209/158; 209/173; 209/428

[58] Field of Search ..... 209/17, 155, 157–161, 209/463, 464, 423, 424, 428, 173

[56] References Cited

U.S. PATENT DOCUMENTS

| | | | |
|---|---|---|---|
| 1,639,915 | 8/1927 | Wilmot | 209/157 X |
| 2,150,918 | 3/1939 | Foulke | 209/155 X |
| 2,620,069 | 12/1952 | Wendt | 209/159 X |
| 2,698,087 | 12/1954 | Call et al. | 209/158 |
| 3,421,620 | 1/1969 | Lapeyre | 209/157 |
| 3,682,299 | 8/1972 | Conley et al. | 209/17 |

FOREIGN PATENT DOCUMENTS

| | | | |
|---|---|---|---|
| 30320 | 2/1933 | Netherlands | 209/139 R |

*Primary Examiner*—Ralph J. Hill
*Attorney, Agent, or Firm*—B. P. Fishburne, Jr.

[57] ABSTRACT

To avoid using salt in a costly flotation separator process for various products of differing specific gravities, a fresh water flotation system is employed having a controlled buoyancy zone in which an induced current or up-flow elevates the product component of lesser specific gravity causing it to overflow a product conveyor divider member and to settle on that side of the conveyor away from the product component of greater specific gravity. The separation of clam meat from clam shells is envisicned.

4 Claims, 3 Drawing Figures

CONTROLLED BUOYANCY SEPARATOR APPARATUS AND METHOD

BACKGROUND OF THE INVENTION

The objective of the present invention is to drastically improve on the traditional prior art apparatus and method of separating comestibles and other product components of differing specific gravity by flotation. When a product such as clam meat and shells are introduced into a flotation tank containing a saline solution of sufficient concentration, the lighter clam meat will float to the surface and can be scooped up while the heavier shells remain at the bottom of the tank. Variations of this procedure are known in the prior art including separator tanks equipped with product infeed and removal conveyors.

The main difficulty with the prior art flotation process is that the salinity concentration of the flotation bath constantly drops and therefore some of the meat or other light product component being harvested sinks to the bottom of the tank and is discarded with the shells or other waste component, resulting in valuable product loss and lessened production. Also, the cost of salt in the prior art method is very high.

The present invention completely eliminates these drawbacks in the prior art by providing a simple and economical fresh water product separator and method of wide versatility in terms of its ability to separate many different types of product components including shellfish and other comestibles. In lieu of a saline bath to effect the separation of lighter product components from heavier components by differential flotation, the present invention utilizes an artificially induced circulation of the fresh water or another fluid in one zone of the apparatus to effect the desired separation of product components having different specific gravities. More particularly, a pumping system induces a current upflow through one side of a foraminous elevator means for the product causing the lighter product component to rise to the top of and then to overflow a submerged divider and to then settle on the foraminous elevator means on the side thereof remote from the heavier product component which is unable to overflow the top of the submerged divider. The thus separated product components continue to be conveyed upwardly through the fresh water bath beyond the controlled buoyance zone for further washing prior to the discharge of the separated components into separate receivers beyond the top of the elevator means. The process is very efficient and the apparatus used to practice the process is reliable and economical. There is virtually no usable product waste and the necessity for using expensive salt and constantly adjusting salinity is entirely avoided.

A very important aspect of the invention resides in the fact that the product components undergoing separation are able to travel upwardly continuously without interruption while passing through the controlled buoyancy zone and thereafter until the separated components reach the discharge station. It is unnecessary to interrupt continuous product transport through the system while induced flotation separation is being carried out. This renders the process faster and therefore more economical.

DETAILED DESCRIPTION

Figure 1:
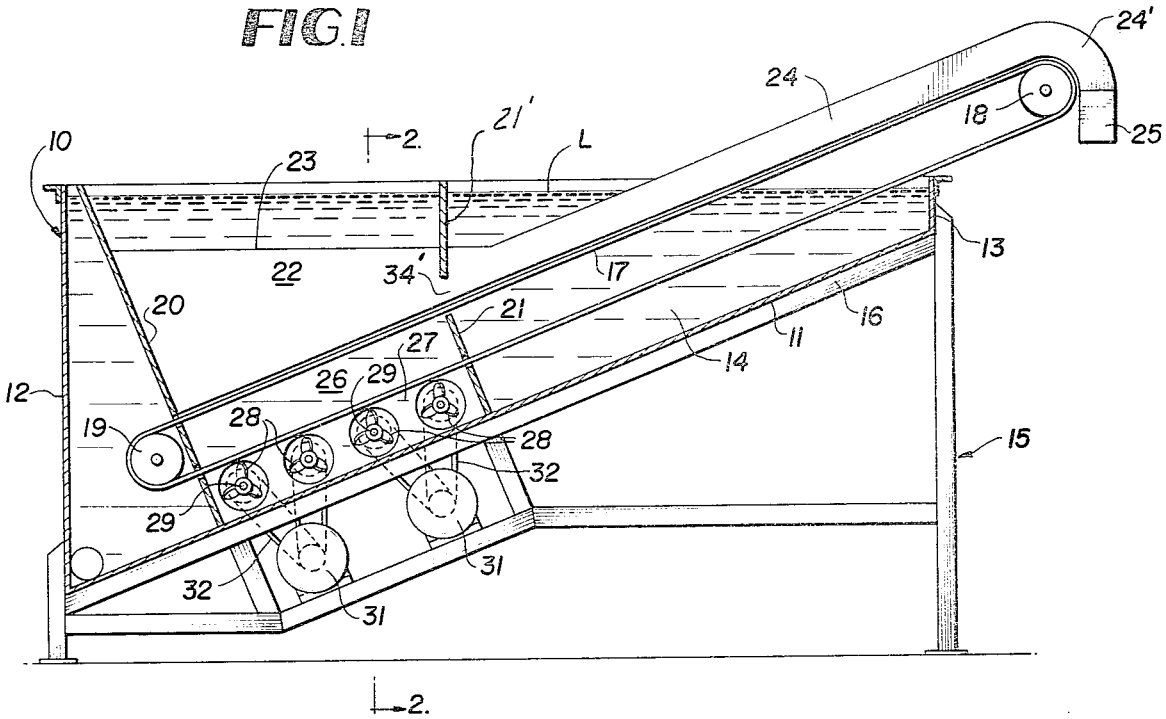
FIG. 1 is a side elevation, partly in cross section, of an apparatus employed in the practice of the method.

Referring to the drawings in detail wherein like numerals designate like parts, a separator apparatus for comestibles and other products comprises an open top tank 10 of wedge formation including a bottom wall 11 sloping at about 30 degrees to the horizontal, a vertical wall 12 defining one end of the tank, namely its deep end, and a short opposite end wall 13 defining the shallow end of the wedge-like tank. The tank 10 also includes parallel vertical side walls 14. The tank is preferably formed of stainless steel and is supported in a level attitude by suitable framework 15 including legs and a support member or members 16 beneath the inclined bottom wall of the tank. During the practice of the method, the tank is maintained substantially filled with fresh water up to a level L, as illustrated. Tank water supply and drainage means are conventional.

Spaced above the tank bottom wall 11 in parallel relation thereto is a product elevator in the form of a powered endless conveyor belt 17 preferably formed of stainless steel mesh which allows water or other fluid to circulate freely therethrough. The upper run of the belt 17 is disposed generally centrally in the wedge-like tank and emerges from the top of the tank near the shallow end thereof to pass around an upper conveyor roll 18 above the tank and somewhat downstream from the end wall 13. A second conveyor belt roll 19 is deeply submerged in the tank near its bottom corner defined by the juncture of the walls 11 and 12. Either of the rolls 18 or 19 may be powered by conventional means, not shown.

Next to the interior side of the conveyor roll 19, a baffle plate 20 rises from the tank bottom wall 11 at right angles thereto and extends to the top of the tank and completely between its side walls 14. The top and bottom runs of conveyor belt 17 pass through slots formed in the baffle plate 20. A parallel baffle plate 21 rises from the tank bottom wall 11 near the longitudinal center of such wall and includes a top extension 21' terminating at the top of the tank 10, with a suitable opening 34' being provided for the passage of the heavier product component 33 between the lower edge of plate extension 21' and the upper run of mesh belt 17. The space between the baffle plates 20 and 21–21' forms a zone of controlled buoyancy or flotation in the separator tank, as will be further discussed.

Figure 2:
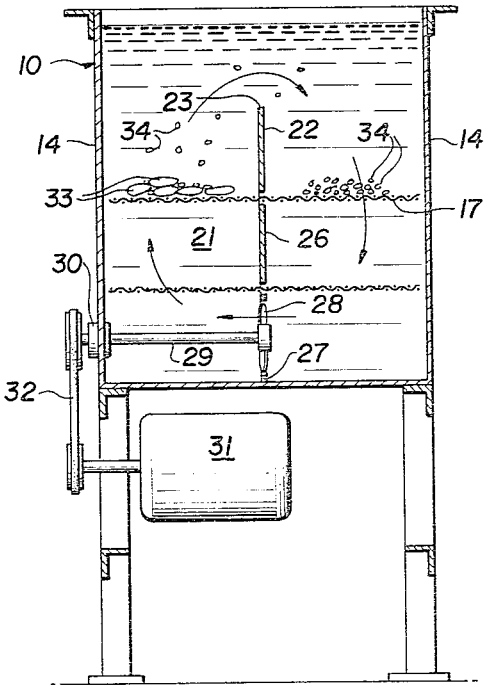
FIG. 2 is an enlarged transverse vertical section taken on line 2—2 of FIG. 1.
Figure 3:
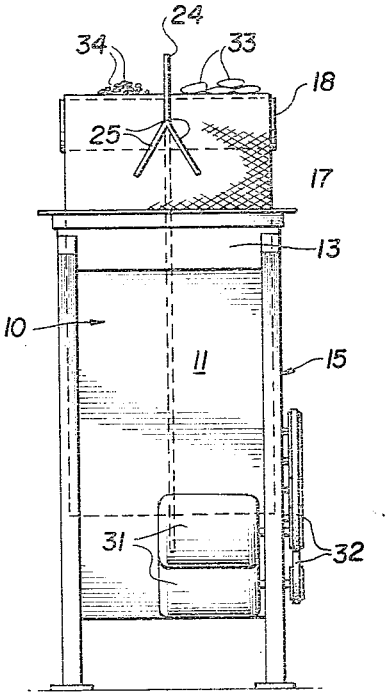
FIG. 3 is an end elevation of the apparatus looking toward its product discharge end.

As shown in FIG. 2, the belt 17 spans the tank 10 completely between its side walls 14. At the transverse center of the tank and belt, an upper divider plate 22 extends forwardly from the baffle plate 20 and has a submerged horizontal top edge 23 within the controlled buoyancy zone defined by baffle plates 20 and 21 and the two tank side walls. Beyond this zone, the upper divider plate 22 has an inclined extension 24 following the top run of the belt 17 to the top thereof and the extension 24 curves about the roll 18 at 24' and terminates in a pair of downwardly divergent product deflectors 25 at the product component discharge station of the apparatus.

In the mentioned zone between the baffle plates 20 and 21, a fixed intermediate tank divider 26 is provided at the transverse center of the tank and a lower divider plate 27 in the same zone is similarly provided below the bottom run of the belt 17.

Within provided openings of the lower divider plate 27 are placed pumping propellers 28 mounted on rotary shafts 29 extending beyond one tank side wall 14, FIG. 2, and supported by sealed bearings 30. Pairs of the propellers 28 are driven by motors 31 whose drive shafts are coupled through suitable gearing 32 with the propeller shafts 29. When driven at proper speeds, the several propellers can induce a continuous circulation of tank water in the direction of the arrows shown in FIG. 2 upwardly through the foraminous belt 17 on one side of the tank divider plates and downwardly on the other side, the circulating current of water flowing over the top edge 23 of upper divider plate 22 in the zone of controlled buoyancy between the baffle plates 20 and 21. The speed of rotation of the several propellers can be adjusted to meet requirements.

The described apparatus is used in the practice of the method in the following manner. With the tank 10 substantially filled with fresh water as indicated and with the foraminous belt 17 traveling continuously at a predetermined speed in the direction of the arrow, the product such as clam shells 33 and clam meat 34 is placed randomly in the separator tank substantially at the baffle plate 20 and on one side of upper divider plate 22, FIG. 2. The meat and shells at this time are mixed randomly and require separation in accordance with the invention.

The propellers 28 are operated at the required speed to create the water circulation in the controlled buoyancy zone, as previously described. There is an up-flow or current through the top run of belt 17 in this zone immediately ahead of the baffle plate 20. This controllable up-flow or current lifts the lighter product component, namely the meat 34 of the described product. The induced up-flow pushes the meat 34 upwardly on one side of the separator plate 22 in the controlled buoyancy zone between the baffle plates 20 and 21. Upon reaching the top level edge 23 of fixed divider plate 22, the induced current resulting from the operation of the propellers 28 will cause the elevated meat to flow over the edge 23 and settle downwardly on the far side of divider plate 22 away from the shells 33. The shells 33 being of greater specific gravity than the meat will not rise with the induced current of water or if they rise slightly from the belt 17, they will never flow over the top edge 23. The downward component of the induced water current, FIG. 2, also assists the meat particles 34 in rapidly settling back onto the continuously moving belt 17 after they have been separated from the shells, as described. The separation process can be carried out with a wide variety of comestibles and other non-food products having components of differing specific gravities.

When the separated product passes beyond the downstream end of the controlled buoyancy zone, that is beyond the baffle plate 21, the product is no longer subjected to the circulating or pumping action of the propellers 28 and the tank water in which the product is still immersed for further washing is substantially calm. The divider extension 24 keeps the separated product components 33 and 34 from comingling in the bath until the belt 17 finally lifts them from the top of the tank 10 and delivers them around the roll 18 which defines the product discharge station. At this station, the curved divider portion 24 and deflectors 25 cause the two product components to pass separately into suitable receivers, not shown, positioned below the discharge station, such as further tanks or further processing conveyor means.

In lieu of simply circulating water in the controlled buoyancy zone, another fluid such as air can be pumped in to induce lifting of the lighter product component. In lieu of having the pumping propellers 28 on horizontal axis drive shafts, they could, if desired, be operated by vertical axis shafts at the bottom of the separating zone and on the left-hand side of dividers 22, 26 and 27 in FIG. 2. The same ultimate result would still be produced. Other types of pumping means, such as jet pumps and the like, could be used in lieu of propellers. The invention apparatus is not limited in the invention to the preferred form of apparatus shown in the drawings.

In the controlled buoyancy zone, a delicate control of buoyancy can be achieved by regulating the speed of the pumping means. The tank water has a buoyant effect on all products being handled according to their specific gravities and volume. Some product components will require only a very gentle induced current or circulation to push them up and over the top edge 23. Other components which are much heavier will require a stronger circulation which can be achieved by faster pumping action. It can be seen that the apparatus and method are extremely versatile in this respect.

The essence of the method, therefore, resides in the use of a fresh water flotation tank in which continually travels a submerged product elevator or conveyor, a stationary tank divider preferably at the middle of the foraminous conveyor and having a submerged top edge at least in a defined zone of controllable buoyancy, and means to regulate such buoyancy.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A controlled buoyancy separator for product components of different specific gravities comprising a tank adapted to contain a liquid of lesser specific gravity than the product components requiring separation, a single liquid permeable inclined product conveying and elevating belt including a lower portion submerged in the liquid within the tank and another portion extending above and outside of the tank, said belt having longitudinal edges which are closely adjacent to opposite side walls of the tank, a divider wall for the tank near the center of said belt and parallel to the tank side walls including a portion above, following and closely spaced from the top run of said belt, said last-named portion of the tank divider wall being partly submerged in the liquid within the tank and extending with said belt above and outside of the tank, spaced transverse walls within the tank substantially at right angles to said divider wall and defining a product inlet guide within the tank above said belt and also defining within the tank a restricted zone of controllable buoyancy, and power operated liquid impeller means within the tank near the bottom wall of the tank and within said zone and being operable to induce within said zone a continuously circulating current of said liquid upwardly through said permeable belt between one tank side wall and said divider wall and downwardly through said belt on the opposite side of the divider wall and between the divider wall and the opposite side wall of the tank.

2. A controlled buoyancy separator as defined in claim 1, and the tank having an inclined bottom wall beneath said belt in spaced parallel relation thereto, whereby the tank is tapered and diminishes in depth toward one end thereof, and said divider wall including submerged sections in said zone of controllable buoyancy between upper and lower runs of the belt and between the lower run and the tank bottom wall, and said impeller means including bladed impellers positioned to rotate within openings formed in the lowermost section of the divider wall between the lower run of the belt and the tank bottom wall, the portion of the divider wall above the top run of the belt including a level edge section in said zone extending for a substantial distance above said belt and near and below the top of the tank and extending between said spaced transverse walls.

3. A controlled buoyancy separator for product components of different specific gravities comprising a tank adapted to contain a liquid of lesser specific gravity than said components requiring separation, an inclined liquid permeable product component conveying and elevating belt within the tank and being partly submerged in the liquid within the tank and having a discharge end extending exteriorly of the tank, a divider wall within the tank between the side walls thereof and being substantially coextensive lengthwise with said belt and including a portion above and close to the top of the belt near the lateral center of the belt, said portion of the divider wall being partly submerged in the liquid within said tank and partly extending outside of the tank with said belt, transverse wall means within said tank adjacent to the submerged parts of the belt and tank divider wall and defining with the side walls of the tank a zone of controllable buoyancy, and submerged liquid impeller means within the tank near and above the tank bottom wall and below said belt and in said zone and operable to circulate said liquid within said zone upwardly through said permeable belt on one side of the divider wall and downwardly through said belt on the other side of said divider wall.

4. A controlled buoyancy separator as defined in claim 3, and said impeller means comprising bladed impellers substantially in the plane of said divider wall and near the transverse center of said belt and tank.

* * * * *